US012270279B1

(12) United States Patent
Seczon

(10) Patent No.: US 12,270,279 B1
(45) Date of Patent: Apr. 8, 2025

(54) DOWNHOLE VALVE ASSEMBLIES AND METHODS OF RECIRCULATING FLUID USING VALVE ASSEMBLIES

(71) Applicant: Luis Seczon, Fulshear, TX (US)

(72) Inventor: Luis Seczon, Fulshear, TX (US)

(73) Assignee: Oilfield Equipment Development Center Limited, Victoria (SC)

( * ) Notice: Subject to any disclaimer, the term of this patent is extended or adjusted under 35 U.S.C. 154(b) by 28 days.

(21) Appl. No.: 18/198,281

(22) Filed: May 16, 2023

(51) Int. Cl.
*E21B 34/14* (2006.01)

(52) U.S. Cl.
CPC ..... *E21B 34/14* (2013.01)

(58) Field of Classification Search
CPC ..... E21B 34/14
See application file for complete search history.

(56) References Cited

U.S. PATENT DOCUMENTS 2,178,845 A * 11/1939 Baker ..... E21B 34/063 251/145
2,903,074 A * 9/1959 Layton ..... E21B 21/103 166/163
4,427,070 A * 1/1984 O'Brien ..... E21B 34/14 166/317
4,577,702 A * 3/1986 Faulkner ..... E21B 21/00 166/373

* cited by examiner

*Primary Examiner* — David Carroll
(74) *Attorney, Agent, or Firm* — Elliott Law PLLC; Douglas H. Elliott; Nathan Q. Huynh

(57) ABSTRACT

Disclosed herein are downhole valve assemblies, electric submersible pumps, and methods for recirculating fluid which may each include a downhole valve assembly which may include: a housing that may include: an axially disposed cylindrical wall; an axially disposed borehole surrounded by the cylindrical wall; and a housing aperture extending radially through the cylindrical wall to the borehole; a recirculation aperture having a central axis that intersects with the central axis of the housing aperture; a valve coupled to the cylindrical wall, in which the valve may include: a first valve end disposed in the housing aperture; and a second valve end disposed in the borehole; and a plug coupled to the cylindrical wall and having an inner end disposed in the housing aperture.

20 Claims, 9 Drawing Sheets

DOWNHOLE VALVE ASSEMBLIES AND METHODS OF RECIRCULATING FLUID USING VALVE ASSEMBLIES

BACKGROUND

1. Field of Inventions

The field of this application and any resulting patent is downhole valve assemblies and methods of recirculating fluid using valve assemblies.

2. Description of Related Art

Various downhole valve assemblies and methods of recirculating fluid using valve assemblies in wellbores have been proposed including prior art listed on this patent. However, those assemblies and methods lack the combination of steps and/or features of the assemblies and methods claimed herein. Furthermore, it is contemplated that the assemblies and/or methods disclosed herein, including those claimed, solve at least some of the problems those prior art assemblies and methods have failed to solve. Also, it is contemplated that the assemblies and/or methods claimed herein have benefits that would be surprising and unexpected to a hypothetical person of ordinary skill with knowledge of the prior art existing as of the filing date of this application.

SUMMARY

The disclosure herein includes downhole valve assemblies and methods for recirculating fluid which may each include a downhole valve assembly which may include: a housing that may include: an axially disposed cylindrical wall; an axially disposed borehole surrounded by the cylindrical wall; and a housing aperture extending radially through the cylindrical wall to the borehole; a recirculation aperture having a central axis that intersects with the central axis of the housing aperture; a valve coupled to the cylindrical wall, in which the valve may include: a first valve end disposed in the housing aperture; and a second valve end disposed in the borehole; and a plug coupled to the cylindrical wall and having an inner end disposed in the housing aperture.

Additionally, the disclosure herein includes downhole valve assemblies and methods for recirculating fluid which may each include a downhole valve assembly which may include: a housing that may include: a cylindrical wall; a borehole surrounded by the cylindrical wall; a knob extending from the cylindrical wall; a housing aperture extending radially through the knob and the cylindrical wall to the borehole; and a recirculation aperture extending axially from an outer surface of the knob to the plug aperture; a valve coupled to the cylindrical wall, in which the valve may include: a first valve end disposed in the plug aperture; a second valve end disposed in the borehole; and a valve aperture extending through the first valve end; and a plug coupled to the cylindrical wall and disposed in the housing aperture.

Also, the disclosure herein includes downhole valve assemblies and methods for recirculating fluid that may each include: a housing that may include: a cylindrical wall; a borehole extending axially through the housing; a housing aperture extending radially through the cylindrical wall to the borehole; and a flange disposed in the housing aperture and extending from the cylindrical wall; a valve that may include: a first valve end disposed in the plug aperture and abutted against the flange; a second valve end disposed in the borehole; a valve notch disposed between the first valve end and the second valve end; and a valve aperture extending through the first valve end; and a plug coupled to the cylindrical wall and disposed in the housing aperture.

In addition, the disclosure herein includes electric submersible pump assemblies and methods for pumping fluid that may each include: a housing that may include: a pump; a motor couple to the pump; a housing coupled to the pump, in which the housing may include: a cylindrical wall having an interior; a housing aperture extending radially through the cylindrical wall to the interior of the housing; and a recirculation aperture extending axially through the cylindrical wall to the valve aperture; a valve that may include: a first valve end disposed in the housing aperture and abutted against the cylindrical wall; a second valve end disposed in the housing; and a notch portion disposed between the first valve end and the second valve end; a plug coupled to the cylindrical wall and disposed in the housing aperture; and a conduit in fluid communication with the recirculation aperture.

Furthermore, the disclosure herein includes methods for recirculating fluid in a downhole well that may each include: directing fluid in the downhole well into an opening in a valve housing, wherein the fluid flows upwardly in the valve housing; separating a second valve end of a valve from a first valve end of the valve that is coupled to the valve housing, wherein the first valve end has a valve aperture extending therethrough; directing the fluid to flow radially through the valve aperture, wherein pressure in the valve aperture is lower than pressure in the valve housing; with a plug, directing the fluid flowing out of the valve aperture to flow downwardly; directing the fluid to flow downwardly in a conduit past the opening in the valve housing; and directing the fluid to flow out of the conduit into the downhole well.

Moreover, the disclosure herein includes methods for recirculating fluid in a downhole well that may each include: providing a downhole valve assembly that may include: a housing that may include: a borehole extending axially therethrough; and a housing aperture extending radially therethrough to the borehole; a valve that may include: a first valve end disposed in the housing aperture; a second valve end disposed in the borehole; and a valve aperture extending through the first valve end; a plug; and a recirculation conduit in fluid communication with the valve aperture; uncoupling the second valve portion from the first valve portion; directing fluid to flow into the borehole; directing the fluid to flow through the valve aperture; redirecting, with the plug, flow of the fluid from the valve aperture; and directing the fluid to flow into the recirculation conduit.

The disclosure herein includes methods for recirculating fluid in a downhole well that may each include: providing a downhole valve assembly that may include: a housing that may include: a cylindrical wall; a borehole extending axially through the cylindrical wall; a knob extending outwardly from the cylindrical wall; a housing aperture extending radially through the knob and the cylindrical wall to the borehole; and a recirculation aperture extending from the housing aperture through the knob; a valve that may include: a first valve end extending radially through the cylindrical wall; a second valve end disposed in the borehole; and a valve aperture extending through the first valve end; and a plug; uncoupling the second valve portion from the first valve portion; directing fluid to flow into the borehole; directing the fluid to flow through the valve aperture; and redirecting, with the plug, the fluid to flow out of the recirculation aperture.

DETAILED DESCRIPTION

1. Introduction

Figure 1A:
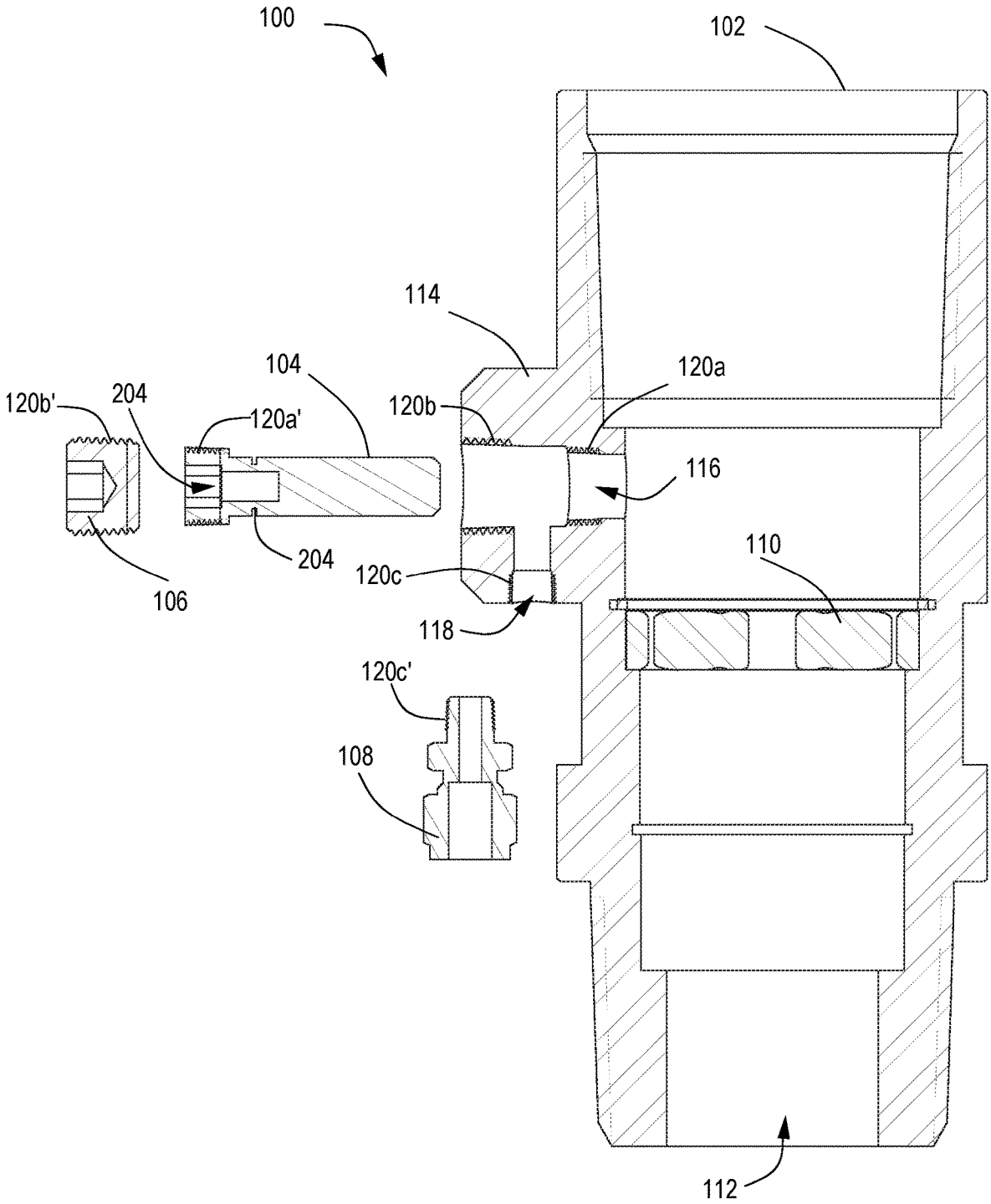
FIG. 1A is an illustration of an exploded cross-sectional side view of a valve assembly.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist with the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "barrier" means any structure that when disposed in an aperture of a structure, e.g., a space within a housing, is capable of preventing, inhibiting, or impeding the passage of fluid, e.g., hydrocarbon, water, or gas, through the aperture past the structure. A valve and a plug are non-limiting examples of barriers. A "valve" is defined as a barrier that has two portions in which when one of the portions is disposed in a space, that portion has sealing contact with the surfaces forming the space and thus, initially provides a seal that helps prevent fluid from flowing past the valve, from one part of the space (e.g., a first aperture) to another part of the space (e.g., a second aperture) and, subsequently can be opened, e.g., by breaking, to permit fluid to flow therethrough. A "plug" is defined as a barrier that when disposed in a space has sealing contact with the surfaces forming the space and thus provides a seal that helps prevent fluid from flowing past the plug, from one part of the space (e.g., a first aperture) to another part of the space (e.g., a second aperture).

The term "aperture" as used herein is defined as any opening in a solid object or structure. For example, an aperture may be an opening that begins on one side of the solid object and ends on the other side of the object. An aperture may alternatively be an opening that does not pass entirely through the object, but only partially passes through, e.g., a groove. An aperture can be an opening in an object that is completely circumscribed, defined, or delimited by the object itself. Alternatively, an aperture can be an opening in the object formed when the object is combined with one or more other objects or structures. One or more apertures may be disposed and pass entirely through a casing, a conduit, and/or a turbine. An aperture may receive another object and permit ingress and/or egress of the object through the aperture. Non-limiting examples of apertures herein are perforations, entry ports, and exit ports.

The term "assembly" as used herein is defined as any set of components that have been fully or partially assembled together. A group of assemblies may be coupled to form a combined assembly, e.g., a body having an inner surface and an outer surface.

The term "coupled" as used herein is defined as directly or indirectly connected, attached, or integral with, e.g., part of. A first object may be coupled to a second object such that the first object is positioned at a specific, or pre-determined, location and orientation with respect to the second object. For example, a housing in which is disclosed an impeller may be coupled at the upper end to a conduit, e.g., the "second conduit" disclosed elsewhere herein. A first object may be either permanently or removably coupled to a second object. Two objects may be "permanently coupled" to each other via adhesive or welding; or they may be "removably coupled" via collets, screws, threading, or nuts and bolts such that they are capable of being easily separated and no longer coupled. Thus, a portion of a housing may be removably coupled to a plug such that the portion of the housing may then be uncoupled and removed from the plug.

Two objects may be "sealingly coupled," e.g., where a first object may be abutted to a second object such that respective adjacent surfaces of the objects would be inhibited fluid from flowing therebetween. For example, a plug may be sealingly coupled to a fluid conduit where, in some cases, fluid cannot flow between adjacent surfaces of the plug and fluid conduit.

The term "cylindrical" as used herein is defined as shaped like a cylinder, e.g., having straight parallel sides and a circular or oval or elliptical cross-section. A cylindrical body or structure, e.g., housing, plug, or valve, may be completely or partially shaped like a cylinder. A cylindrical body, e.g., housing, plug, or valve, which has an outer diameter that changes abruptly may have a radial face or "lip" extending toward the center axis. A cylindrical body may have an aperture that extends through the entire length of the body to form a hollow cylinder that is capable of permitting fluid to pass through, e.g., water or hydrocarbon. On the other hand, a cylindrical structure may be solid, e.g., rod or peg. A drive shaft assembly is an example of a solid cylindrical body.

The term "disposed" as used herein means having been put, placed, positioned, inserted, or oriented in a particular location. For example, when a second conduit occupies a position within a first conduit, the second conduit is disposed in or within the first conduit. Also, a conduit or some other type of structure or aperture may be disposed on or disposed adjacent another structure or space.

The terms "first," "second," "third," and other ordinal terms, when used to refer to certain things, e.g., structures, are terms that differentiate those things from one another and do not mean or imply anything in terms of importance, sequence, etc.

The term "flow" as used herein, as a verb, noun, or word that modifies another word, e.g., volume, describes or refers to moving, or the movement or passage of a fluid, preferably substantially in a particular direction. For example, reservoir fluid may flow in a downward direction in the interior of a conduit or an annular space. Such flow can be laminar or turbulent, or a combination of laminar and turbulent. Flow volume in that context may be measured in a variety of units, e.g., gallons or liters. Time may be measured in seconds, minutes, or hours.

The term "fluid" as used herein is defined as a material that is capable of flowing. A fluid may be a liquid or a gas or some mixture of liquid and gas. A fluid may absorb heat. A fluid has inherent properties which may in certain embodiments are measurable, such as viscosity, anti-foaming, thermal stability, thermal conductivity, and thermal capacity.

The term "horizontal wellbore" as used herein is defined as a wellbore that has been drilled using some type of directional drilling technique and includes at least a portion that is more than 45 degrees from vertical. However, at least a portion of any horizontal wellbore is vertical or at least substantially vertical, as the term "vertical" is used in the oil and gas industry, i.e., pointed toward the center of the earth. For example, the upper portion of the wellbore closest to the surface is typically vertical, or substantially vertical, and the lower portion is less vertical and closer to perfectly horizontal relative to the earth's surface above that portion of the wellbore. For example, a horizontal wellbore may include a wellbore that is formed as a kick-out wellbore from an originally drilled vertical wellbore. Any horizontal wellbore mentioned herein is defined to include a "heel," which is the part, point, or section of the wellbore where the portion of the wellbore changes from being vertical to being horizontal, and the "toe" which refers to the end of the wellbore. In any discussion of wellbores herein, there is no restriction in length unless stated specifically otherwise, a central part of any elongated space, such as a conduit.

The term "housing" as used herein is defined as a structure, preferably a cylindrical sleeve, configured to be filled with fluid, e.g., water or hydrocarbon. A housing may have a central aperture which may be the space between the walls of the housing and extending from one end, e.g., the upper end, to the other end, e.g., the lower end. A housing may have one or more threaded ends for coupling with another housing. Multiple housings may be coupled axially to form a larger housing.

The term "knob" as used herein is defined as a structure and/or projection extending, e.g., protruding, from an object or structure. For example, a knob may protrude from a housing.

The term "port" as used herein is defined as an aperture in a structure for providing the ingress or egress of fluid. A port disposed in a casing, conduit, or turbine may be referred to as a "fluid port."

The term "pressure" as used herein means force(s), including but not limited to the forces exerted in every direction in an enclosed space, e.g., forces applied against the inside surfaces of any structure defining the enclosed space. Pressure may be, for example, exerted against a surface of an object, e.g., housing, plug, valve, impeller, and/or conduit, from fluid flowing across the surface. Non-limiting examples of pressure include: (a) pressure in an annular space inside the wellbore, e.g., the pressure in an annular space, between the inner surface of the upper part of the first conduit, e.g., the casing, and the outer surface of the upper part of the second conduit, and above the seal (e.g., packer); (b) pressure inside a pump; (c) pressure inside a valve assembly; (d) pressure inside a recirculation conduit; and (e) pressure in an annular space adjacent an opening of a recirculation conduit and a motor. Although pressure is normally measured in kilopascals, kilopascals can be converted to joules, as a unit of energy, to combine with potential energy. Thus, pressure (measured in joules) and potential energy (measured in joules) in a reservoir may be combined.

The term "providing" as used herein is defined as making available, furnishing, supplying, equipping, or causing to be placed in position.

The term "space" as used herein means any volumetric space. For example, it may refer to some empty volume between two objects, structures, points, lines, edges, or surfaces, i.e., not occupied by anything solid. A non-limiting example of space is "annular space," e.g., the space between the inside surface of one conduit and the outside surface of another conduit disposed inside the one conduit.

The term "surface" as used herein is defined as any boundary of a structure. A surface may also refer to that cylindrical area that extends radially around a cylinder which may, for example, be part of a plug or valve. A surface may also refer to that cylindrical area that extends radially around a cylinder which may, for example, be part of a housing, a stator, a rotor, or a shaft assembly. A "surface" may have any geometry, e.g., curved or flat. A surface may have irregular contours. A surface may be formed from components, e.g., bearing assemblies, bodies, and/or housings, coupled together. Coupled components may form irregular surfaces.

The term "unitary" as used herein means having the nature, properties, or characteristics of a single unit. For example, a shaft and a rotor may be unitary where they are connected, directly or indirectly, and fulfill the intended purpose of being rotated. Also, a shaft and an impeller may be unitary where they are connected, directly or indirectly, and fulfill the intended purpose of being rotated to move fluid, e.g., water, hydrocarbon, or lubricant.

The terms "upper" and "lower" as used herein are relative terms describing the position of one object, thing, or point positioned in its intended useful position, relative to some other object, thing, or point also positioned in its intended useful position, when the objects, things, or points are compared to distance from the center of the earth. For example, the term "upper" identifies any object or part of a particular object that is farther away from the center of the earth than some other object or part of that particular object, when the objects are positioned in their intended useful positions.

The term "valve assembly" means an assembly of components that include one or more barriers capable of permitting or inhibiting flow of fluid through conduits that are disposed in a wellbore.

The term "wellbore" as used herein is defined as a drilled elongated cylindrical borehole extending through the formation from the surface, where the drilling was initiated, to the endpoint where the drilling was terminated. Depending on the context, the term may also include any downhole components placed within a borehole, e.g., casing, cement, tubing, packers, etc.

3. Certain Specific Embodiments

The disclosure herein includes downhole valve assemblies and methods for recirculating fluid which may each include a downhole valve assembly which may include: a housing that may include: an axially disposed cylindrical wall; an axially disposed borehole surrounded by the cylindrical wall; and a housing aperture extending radially through the cylindrical wall to the borehole; a recirculation aperture having a central axis that intersects with the central axis of the housing aperture; a valve coupled to the cylindrical wall, in which the valve may include: a first valve end disposed in the housing aperture; and a second valve end disposed in the borehole; and a plug coupled to the cylindrical wall and having an inner end disposed in the housing aperture.

Additionally, the disclosure herein includes downhole valve assemblies and methods for recirculating fluid which may each include a downhole valve assembly which may include: a housing that may include: a cylindrical wall; a borehole surrounded by the cylindrical wall; a knob extending from the cylindrical wall; a housing aperture extending radially through the knob and the cylindrical wall to the borehole; and a recirculation aperture extending axially from an outer surface of the knob to the plug aperture; a valve coupled to the cylindrical wall, in which the valve may include: a first valve end disposed in the plug aperture; a second valve end disposed in the borehole; and a valve aperture extending through the first valve end; and a plug coupled to the cylindrical wall and disposed in the housing aperture.

Also, the disclosure herein includes downhole valve assemblies and methods for recirculating fluid that may each include: a housing that may include: a cylindrical wall; a borehole extending axially through the housing; a housing aperture extending radially through the cylindrical wall to the borehole; and a flange disposed in the housing aperture and extending from the cylindrical wall; a valve that may include: a first valve end disposed in the plug aperture and abutted against the flange; a second valve end disposed in the borehole; a valve notch disposed between the first valve end and the second valve end; and a valve aperture extending through the first valve end; and a plug coupled to the cylindrical wall and disposed in the housing aperture.

In addition, the disclosure herein includes electric submersible pump assemblies and methods for pumping fluid that may each include: a housing that may include: a pump; a motor couple to the pump; a housing coupled to the pump, in which the housing may include: a cylindrical wall having an interior; a housing aperture extending radially through the cylindrical wall to the interior of the housing; and a recirculation aperture extending axially through the cylindrical wall to the valve aperture; a valve that may include: a first valve end disposed in the housing aperture and abutted against the cylindrical wall; a second valve end disposed in the housing; and a notch portion disposed between the first valve end and the second valve end; a plug coupled to the cylindrical wall and disposed in the housing aperture; and a conduit in fluid communication with the recirculation aperture.

Furthermore, the disclosure herein includes methods for recirculating fluid in a downhole well that may each include: directing fluid in the downhole well into an opening in a valve housing, wherein the fluid flows upwardly in the valve housing; separating a second valve end of a valve from a first valve end of the valve that is coupled to the valve housing, wherein the first valve end has a valve aperture extending therethrough; directing the fluid to flow radially through the valve aperture, wherein pressure in the valve aperture is lower than pressure in the valve housing; with a plug, directing the fluid flowing out of the valve aperture to flow downwardly; directing the fluid to flow downwardly in a conduit past the opening in the valve housing; and directing the fluid to flow out of the conduit into the downhole well.

Moreover, the disclosure herein includes methods for recirculating fluid in a downhole well that may each include: providing a downhole valve assembly that may include: a housing that may include: a borehole extending axially therethrough; and a housing aperture extending radially therethrough to the borehole; a valve that may include: a first valve end disposed in the housing aperture; a second valve end disposed in the borehole; and a valve aperture extending through the first valve end; a plug; and a recirculation conduit in fluid communication with the valve aperture; uncoupling the second valve portion from the first valve portion; directing fluid to flow into the borehole; directing the fluid to flow through the valve aperture; redirecting, with the plug, flow of the fluid from the valve aperture; and directing the fluid to flow into the recirculation conduit.

The disclosure herein includes methods for recirculating fluid in a downhole well that may each include: providing a downhole valve assembly that may include: a housing that may include: a cylindrical wall; a borehole extending axially through the cylindrical wall; a knob extending outwardly from the cylindrical wall; a housing aperture extending radially through the knob and the cylindrical wall to the borehole; and a recirculation aperture extending from the housing aperture through the knob; a valve that may include: a first valve end extending radially through the cylindrical wall; a second valve end disposed in the borehole; and a valve aperture extending through the first valve end; and a plug; uncoupling the second valve portion from the first valve portion; directing fluid to flow into the borehole; directing the fluid to flow through the valve aperture; and redirecting, with the plug, the fluid to flow out of the recirculation aperture.

In any one of the electric downhole valve assemblies and methods disclosed herein, the housing may additionally include a knob extending radially from the cylindrical wall.

In any one of the electric downhole valve assemblies and methods disclosed herein, the recirculation aperture may extend axially from an outer surface of the knob to the housing aperture.

In any one of the electric downhole valve assemblies and methods disclosed herein, the plug may be threadably coupled to the cylindrical wall.

In any one of the electric downhole valve assemblies and methods disclosed herein, the plug and the valve may be separated.

In any one of the electric downhole valve assemblies and methods disclosed herein, the plug may be capable of directing fluid to flow from the housing to the recirculation aperture.

In any one of the electric downhole valve assemblies and methods disclosed herein, the plug may be capable of redirecting fluid from the housing to flow away from the plug.

T In any one of the electric downhole valve assemblies and methods disclosed herein, the plug may be capable of redirecting fluid from the housing to flow from a radial direction to an axial direction relative to a central axis of the housing.

In any one of the electric downhole valve assemblies disclosed herein, the first valve end may be disposed in the plug aperture.

In any one of the electric downhole valve assemblies disclosed herein, the first valve end may have a diameter greater than the diameter of the second valve end.

In any one of the electric downhole valve assemblies disclosed herein, the valve may include a notch located between the first valve end and the second valve end, and the notch may have a diameter less than a diameter of the second valve end.

In any one of the electric downhole valve assemblies and methods disclosed herein, the valve aperture may also extend through at least a portion of the second valve end.

Any one of the electric downhole valve assemblies and methods disclosed herein may further include a screen disposed in the borehole.

Any one of the electric downhole valve assemblies and methods disclosed herein may further include a screen disposed in the borehole below the valve.

Any one of the electric downhole valve assemblies and methods disclosed herein may further include a screen disposed in the borehole capable of inhibiting any portion of the valve from passing through the screen.

In any one of the electric downhole valve assemblies and methods disclosed herein, the first valve end and the second valve end may be capable of being separated at the valve notch.

In any one of the electric downhole valve assemblies and methods disclosed herein, the second valve end may be capable of being broken from the valve notch.

In any one of the electric downhole valve assemblies and methods disclosed herein, the second valve end may be capable of being separated from the valve notch.

In any one of the electric downhole valve assemblies and methods disclosed herein, the conduit may extend from housing aperture to at least the motor.

In any one of the electric submersible pump assembly or methods disclosed herein, the conduit may extend from housing aperture past the motor.

In any one of the electric submersible pump assembly or methods disclosed herein, the conduit may be coupled to the cylindrical wall.

In any one of the electric submersible pump assembly or methods disclosed herein, fluid in the interior of the cylindrical wall may be capable of flowing through the housing aperture and the conduit.

Any one of the electric submersible pump assembly or methods disclosed herein may further include a bubble-breaking screen disposed below the pump.

Any one of the electric submersible pump assembly or methods disclosed herein may further include a bubble-breaking screen that may be coupled to the motor.

Any one of the electric submersible pump assembly or methods disclosed herein may further include a bubble-breaking screen disposed below the motor.

Any one of the electric submersible pump assembly or methods disclosed herein may further include a bubble-breaking screen capable of breaking one or more bubbles in a fluid into smaller bubbles.

In any one of the methods disclosed herein, the first direction may be axial to the valve housing.

In any one of the methods disclosed herein, the first direction may be towards an earth surface.

In any one of the methods disclosed herein, the second direction may be radial to the valve housing.

In any one of the methods disclosed herein, the second direction may be orthogonal to the second direction.

In any one of the methods disclosed herein, the third direction may be axial to the valve housing.

In any one of the methods disclosed herein, the third direction may be away from an earth surface.

Any one of the methods disclosed herein may further include directing fluid in the valve housing to flow out of the valve housing.

Any one of the methods disclosed herein may further include directing fluid in the conduit to flow out of the of the conduit towards a motor.

Any one of the methods disclosed herein may further include breaking bubbles in the fluid, with a screen, into smaller bubbles.

Any one of the methods disclosed herein may further include breaking large bubbles in the fluid, with a screen, into smaller bubbles, wherein the fluid having the smaller bubbles may be denser than the fluid having the larger bubbles.

Any one of the methods disclosed herein may further include directing fluid to flow into the borehole.

Any one of the methods disclosed herein may further include directing the fluid to flow from the borehole into the valve aperture.

Any one of the methods disclosed herein may further include redirecting, with the plug, the fluid to flow out of the valve aperture into the recirculation conduit.

Any one of the methods disclosed herein may further include directing the fluid to flow in the housing aperture.

Any one of the methods disclosed herein may further include redirecting, with the plug, the fluid to flow from the valve aperture into the recirculation conduit.

Any one of the methods disclosed herein may further include directing, with the plug, the fluid to flow out of the recirculation conduit.

Any one of the methods disclosed herein may further include fluid flowing into the valve aperture after the second valve portion is detached from the first valve portion.

Any one of the methods disclosed herein may further include directing fluid to flow into the borehole.

Any one of the methods disclosed herein may further include directing the fluid to flow from the borehole into the valve aperture.

Any one of the methods disclosed herein may further include redirecting, with the plug, the fluid to flow out of the valve aperture into the recirculation conduit.

Any one of the methods disclosed herein may further include the fluid flowing upwardly in the borehole.

In any one of the methods disclosed herein, the fluid may flow through a lower end of the housing.

In any one of the methods disclosed herein, the fluid flows radially in valve aperture.

In any one of the methods disclosed herein, the fluid flows from the borehole into the valve aperture.

In any one of the methods disclosed herein, the fluid flows downwardly recirculation conduit.

In any one of the methods disclosed herein, the fluid flows from the valve aperture into the recirculation conduit.

Any one of the methods disclosed herein may further include directing fluid to flow into the borehole.

Any one of the methods disclosed herein may further include directing the fluid to flow from borehole into the valve aperture.

Any one of the methods disclosed herein may further include redirecting, with the plug, the fluid to flow out of the valve aperture into the recirculation aperture.

4. Specific Embodiments in the Drawings

The drawings presented herein are for illustrative purposes only and do not limit the scope of the disclosure or claims. Rather, the drawings are intended to help enable one having ordinary skill in the art to make and use the systems and assemblies and practice the methods disclosed herein.

This section addresses specific versions of downhole valve assemblies shown in the drawings, which include assemblies, elements and parts that can be part of one or more downhole valve assemblies or methods for recirculating fluid. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability than the structures disclosed in the drawings.

Figure 1B:
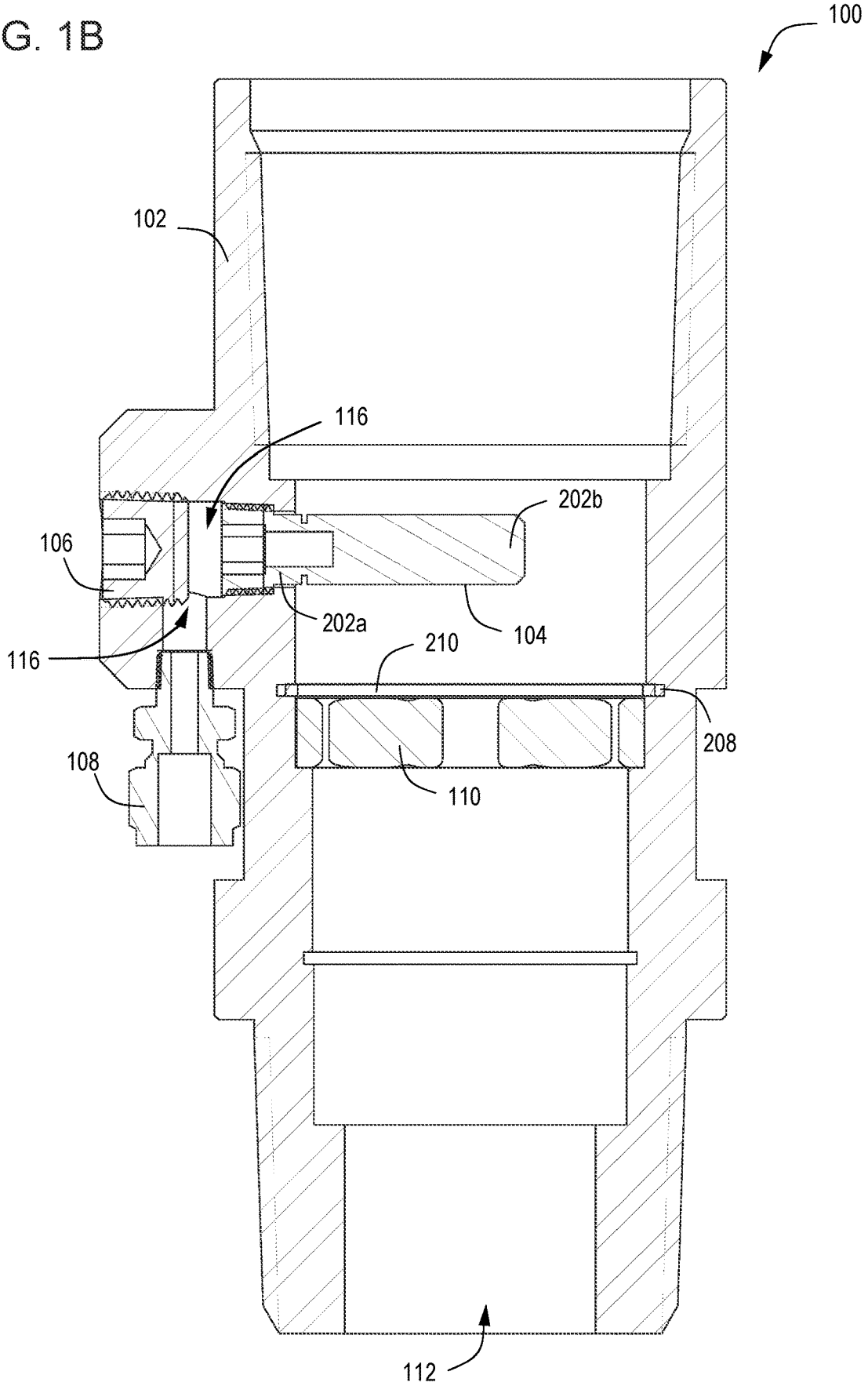
FIG. 1B is an illustration of a cross-sectional side view of an assembled valve assembly.

FIG. 1A is an illustration of an exploded cross-sectional view of a valve assembly 100. FIG. 1B is an illustration of a cross-sectional side view of an assembled valve assembly 100.

Referring to FIGS. 1A-B, a valve assembly 100 includes a housing 102, a valve 104, a plug 106, a tap 108, and a screen 110. The housing 102 is preferably constructed from hardened material, e.g., metal, ceramic, or carbon fiber, which is capable of withstanding high temperature and/or high pressure downhole. Also, the housing 102 is preferably a cylindrical structure. The cylindrical structure is a continuous cylindrical wall. Hence, the housing 102 has an outer surface and an inner surface. The inner surface is continuous and forms a borehole 112.

In addition, a knob 114 protrudes radially, away from the cylindrical wall. A first aperture 116 extends radially through the knob 114 and the cylindrical wall to the borehole 112 (see FIG. 1A). Accordingly, the first aperture 116 and the borehole 112 are capable of fluid communication with each other. In other words, fluid may flow from the borehole 112 through the aperture 116 and out of the first aperture 116.

The first aperture 116 is defined by a first inner cylindrical surface. The first inner cylindrical surface has two female threads 120*a*, 120*b* disposed thereon. A first female thread 120*a* is disposed in the first aperture 116 adjacent the borehole 112. Additionally, a second female thread 120*b* is disposed in the portion of the first aperture 116 surrounded by the knob 114.

A first end portion 202*a* of the valve 104 is preferably disposed in the first aperture 116 and threadably coupled to the housing 102 adjacent the borehole 112. The first end of the valve 104 has a first male thread 120*a*' (disposed on its outer surface) that is threadably coupled to the first female thread 120*a*.

The plug 106 is disposed in the first aperture 116 surrounded by the knob 114 and threadably coupled to the housing 102. The plug 106 has a second male thread 120*b*' (disposed on its outer surface) that is threadably coupled to the second female thread 120*b* on the housing 102. The plug 106 has a socket that is sized, shaped, and configured to receive a key (not shown), e.g., Allen wrench. The key may fit in the socket and may be turned threadably to couple the plug 106 to the housing 102. Having the plug 106 coupled to the housing 102 inhibits fluid from ingress into and/or egress from the housing 102.

In addition, a second aperture 118 extends axially from an outer surface of the knob 114 to the first aperture 116. The second aperture 118 extends from the first aperture 116 through a lower, outer surface of the knob 114. Preferably, a central axis of the second aperture 118 is parallel to a central axis of the housing 102.

Furthermore, the second aperture 118 is defined by a second inner cylindrical surface. The second inner cylindrical surface has a third female thread 120*c* disposed thereon. Accordingly, the third female thread 120*c* is disposed in the second aperture 118 in the knob 114. A portion of the tap 108 is disposed in the second aperture 118. Moreover, that portion is coupled to the housing 102. The tap 108 has a third male thread 120*c*' (disposed on its outer surface) that is threadably coupled to the third female thread 120*c*.

Figure 2A:
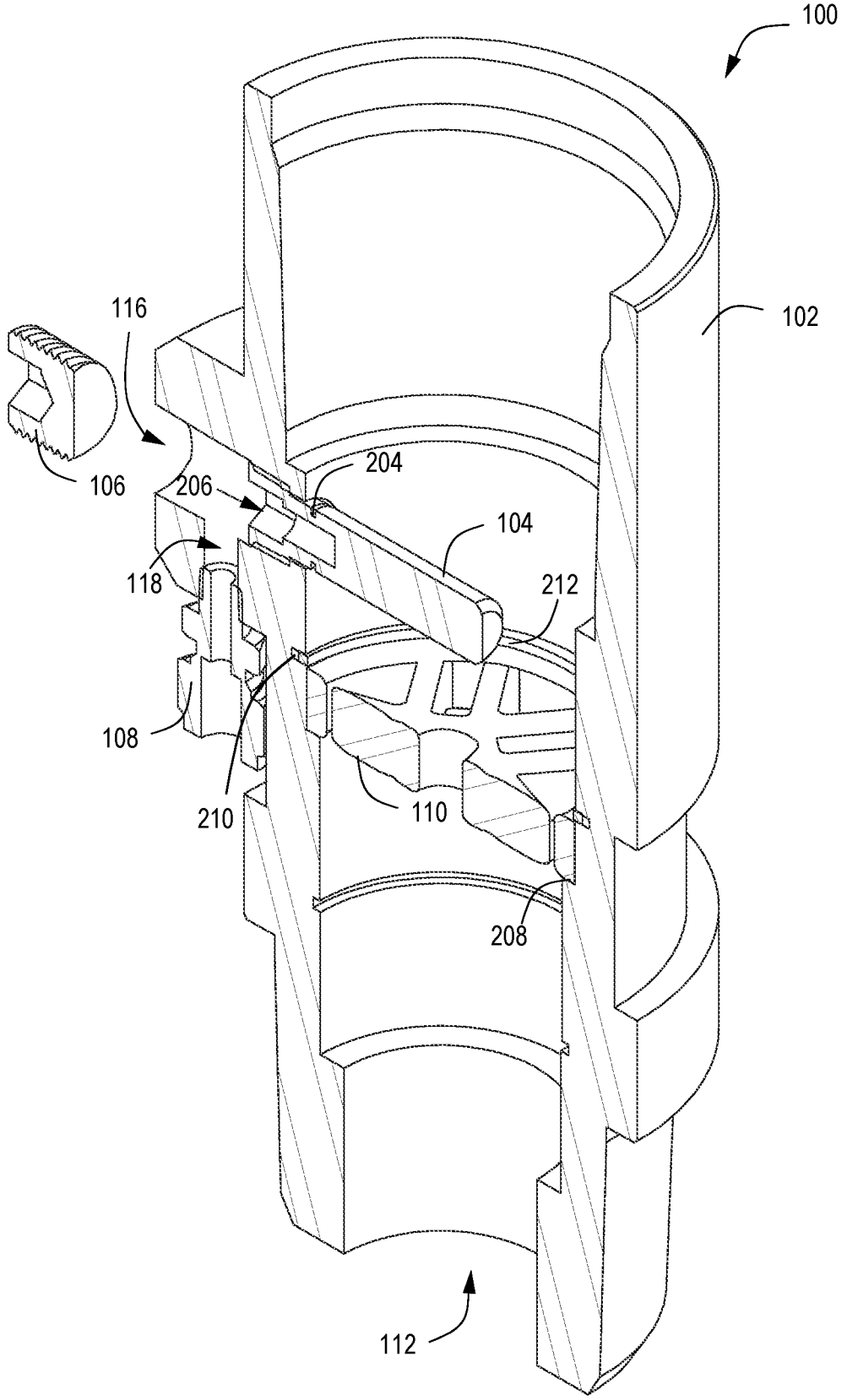
FIG. 2A is an illustration of a perspective cross-sectional side view of a valve assembly having a plug uncoupled therefrom.
Figure 2B:
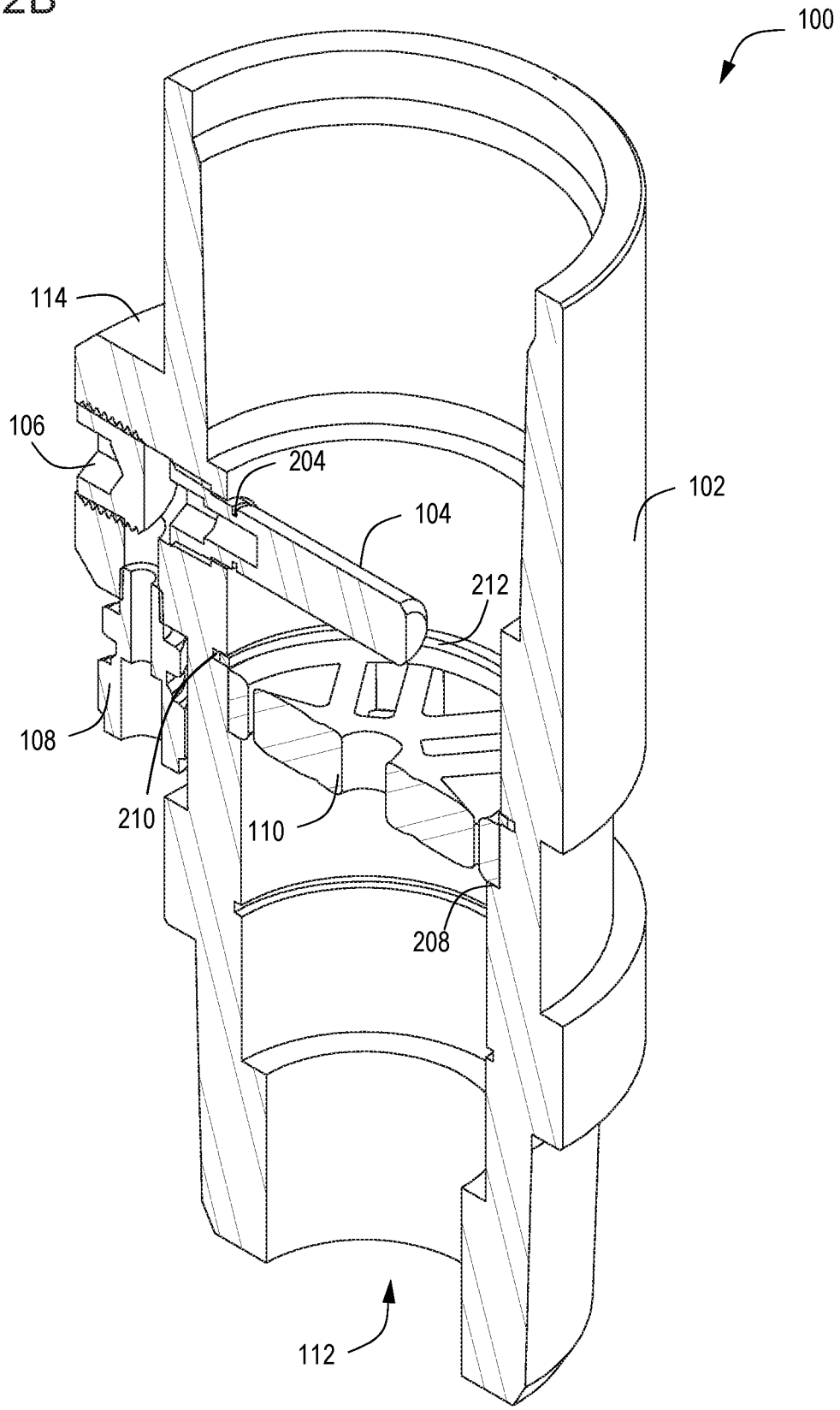
FIG. 2B is an illustration of a perspective cross-sectional side view of an assembled valve assembly.
Figure 2C:
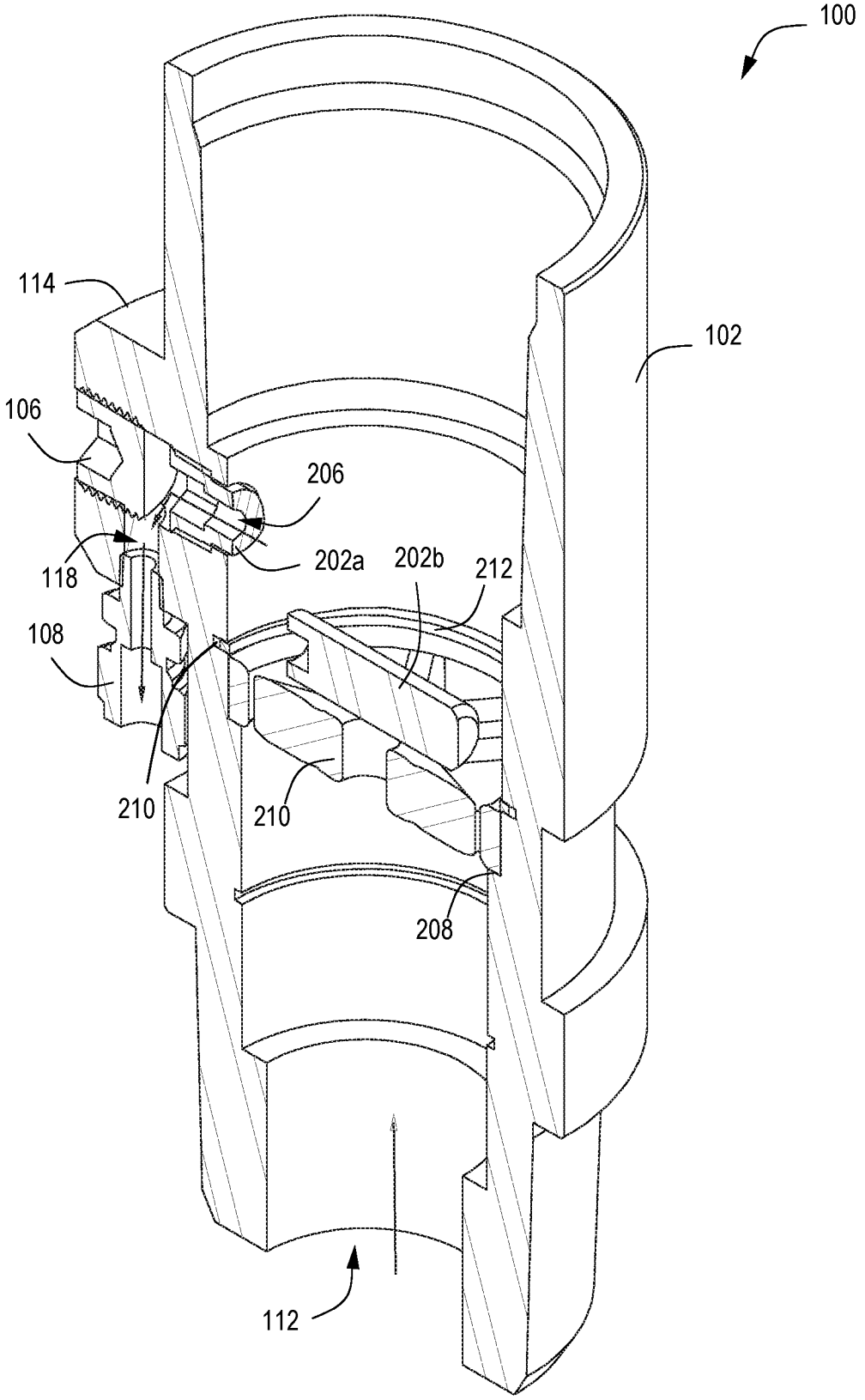
FIG. 2C is an illustration of a perspective cross-sectional side view of an assembled valve assembly including a valve having its first end portion separated from its second end portion.

FIG. 2A is an illustration of a perspective cross-sectional view of a valve assembly 100 having a detached plug 106. FIG. 2B is an illustration of a perspective cross-sectional view of an assembled valve assembly 100. FIG. 2C is an illustration of a perspective cross-sectional side view of an assembled valve assembly 100 including a valve 104 having its first end portion 202*a* separated from its second end portion 202*b*.

Referring to FIGS. 2A-B, a valve assembly 100 includes a housing 102, a valve 104, a plug 106, a tap 108, and a screen 110. The housing 102 is preferably a cylindrical structure. The cylindrical structure is a continuous cylindrical wall. A borehole 112 extends axially through cylindrical wall. Hence, the housing 102 has an outer surface and an inner surface.

The housing 102 has a knob 114 that protrudes, e.g., radially, from the cylindrical wall. A first aperture 116 extends radially through the knob 114 and the cylindrical wall to the borehole 112. A first inner cylindrical surface defines the first aperture 116.

The valve 104 has a first end portion 202*a* disposed in the first aperture 116. The first end portion 202*a* has a first male thread 120*a*' (disposed on its outer surface). The first male thread 120*a*' is threadably coupled to a first female thread 120*a* in the first inner cylindrical surface adjacent the borehole 112. Hence, the valve 104 is threadably coupled to the housing 102. When the valve 104 is threadably coupled to the cylindrical wall of the housing 102, the second end portion 202*b* extends from the first end portion 202*a* and is disposed in the borehole 112, above the screen 110.

Additionally, the valve 104 has a notch 204 disposed between the first end portion 202*a* and the second end portion 202*b*. A valve borehole 206 extends axially from a portion of the second end portion 202*b* through the first end portion 202*a*. The valve borehole 206 does not extend through the second end portion 202*b*.

The section of the valve 104 at the notch 204 is a weak point. Accordingly, referring to FIG. 2C, the first end portion 202*a* and the second end portion 202*b* of the valve 104 can be broken at the notch 204 when force is applied thereto, e.g., a solid metal bar dropped into the housing 102 from surface or a wireline hammer or jar operation. After the valve 104 is broken at the notch 204, the second end portion 202*b* can then be separated from the first end portion 202*a*. The second end portion 202*b* then preferably lands on the screen 110. As a result, the screen 110 preferably inhibits the second end portion 202*b* from falling out of the housing 102.

The inner surface of the cylindrical wall has a flange 208 that extends from the inner surface towards a central axis of the housing 102. The screen 110 is set on the flange 208. Additionally, a groove 210 is disposed in the inner surface adjacent the flange 208. A C-ring 212 is disposed in the groove 210. An inner portion of the C-ring 212 protrudes out of the groove 210. That inner portion of the C-ring 212 is abutted against the screen 110. Accordingly, the C-ring 212 retains the screen 110 between the flange 208 and the C-ring 212.

Referring to the arrows in FIG. 2C, when the second end portion 202*b* is separated from the first end portion 202*a* of the valve 104, fluid that may be flowing inside the borehole 112 would flow into the valve borehole 206. Fluid that would be flowing in the valve borehole 206 would then flow into the first aperture 116. The plug 106 would inhibit the fluid from flowing out of the first aperture 116. Therefore, the plug 106 would cause the fluid to flow through the second aperture 118. Accordingly, the fluid in the second aperture 118 would flow through the tap 108, out of the housing 102.

Figure 4:
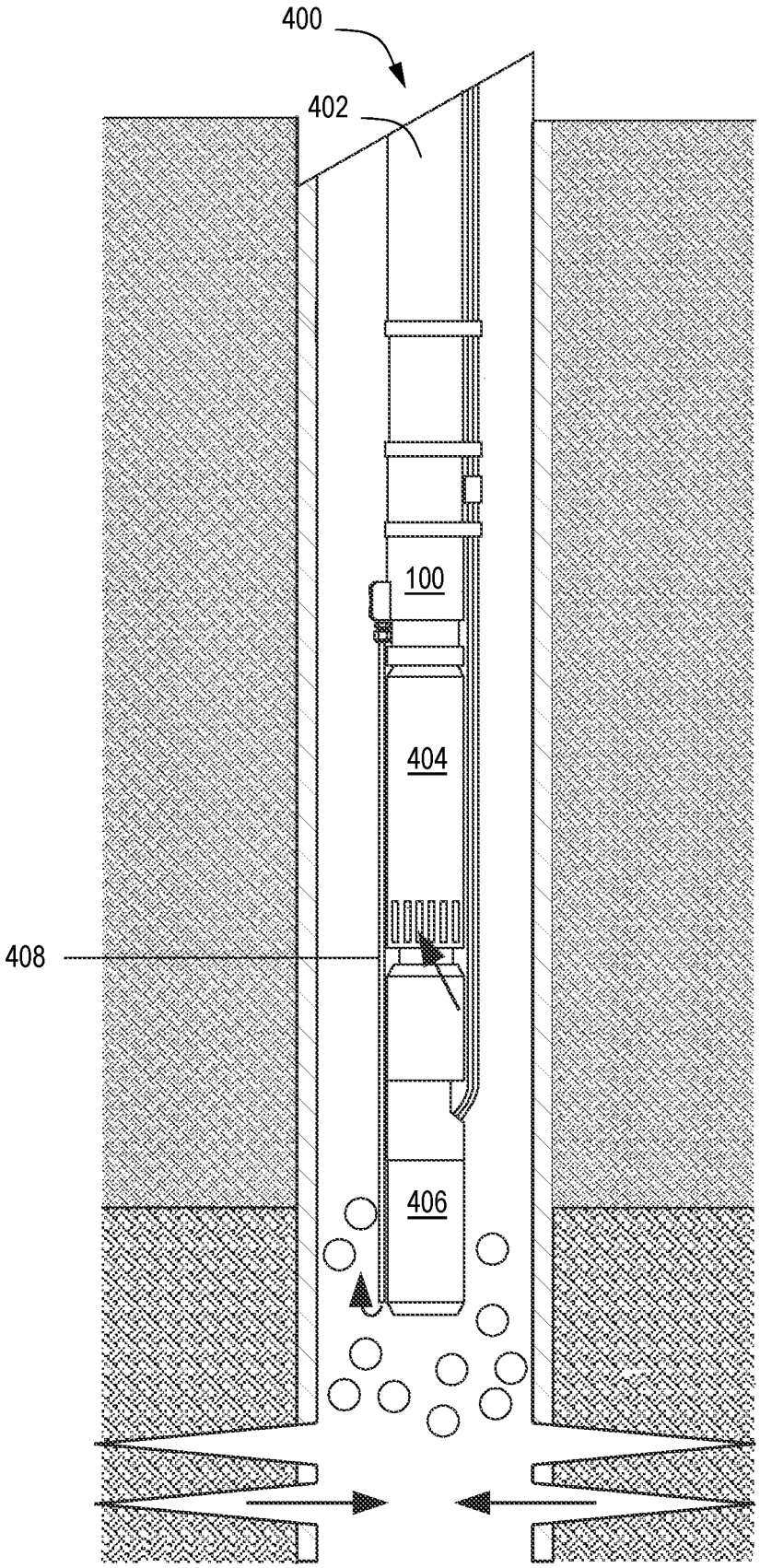
FIG. 4 is an illustration of an electric submersible pump assembly that includes a valve assembly, wherein the electric submersible pump assembly is disposed downhole.

FIG. 4 is an illustration of an electric submersible pump ("ESP") assembly 400 that includes a valve assembly 100, wherein the electric submersible pump assembly 400 is disposed downhole. The ESP assembly 400 includes a tubular string 402, the valve assembly 100, a pump 404, and a motor 406. A lower end of the tubular string 402 is coupled to an upper end of the valve assembly 100. An upper end of the pump 404 is coupled to a lower end of the valve assembly 100. An upper end of the motor 404 is coupled to a lower end of the pump 404.

Figure 3A:
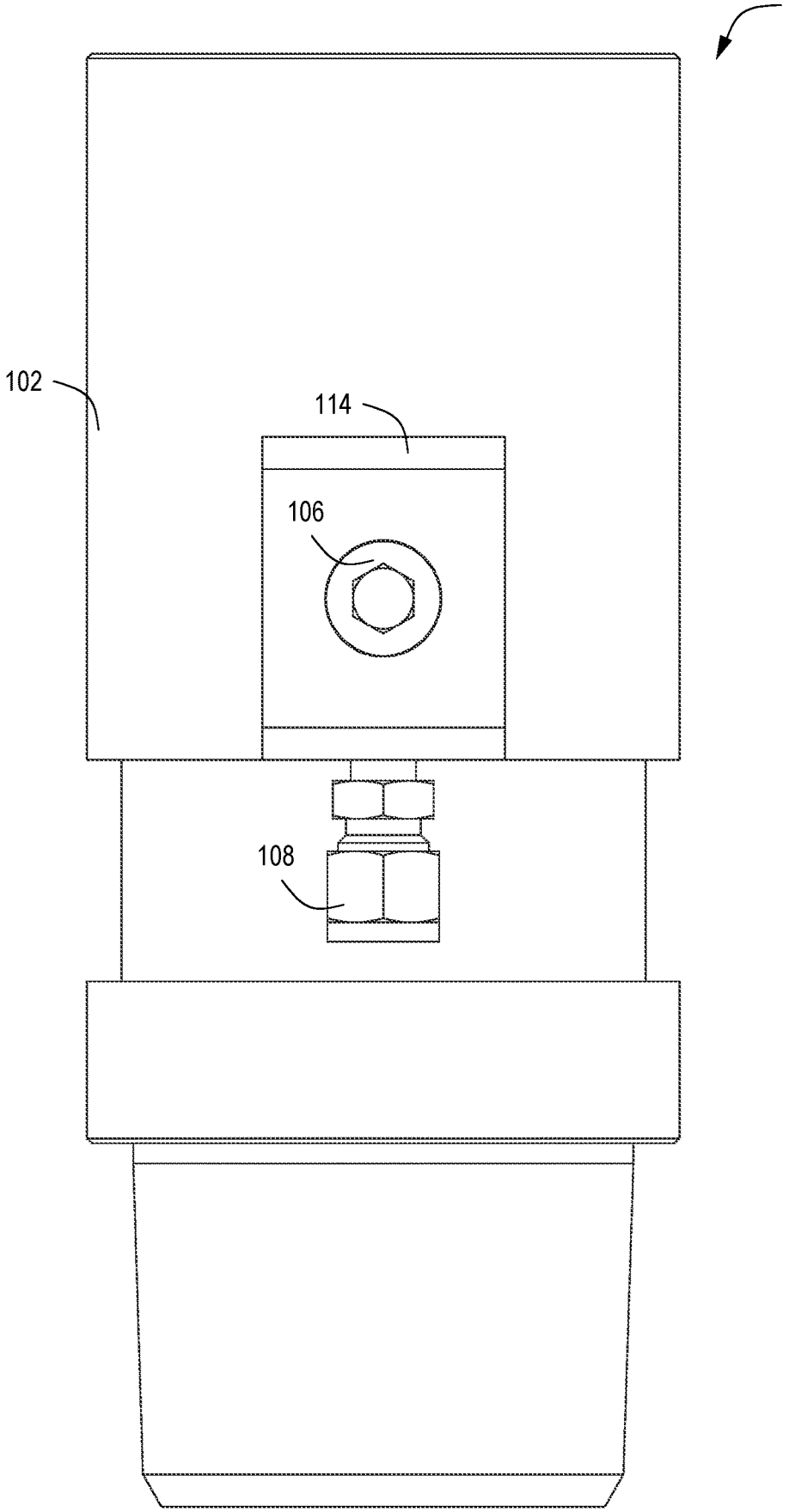
FIG. 3A is an illustration of a frontal profile view of a valve assembly.
Figure 3B:
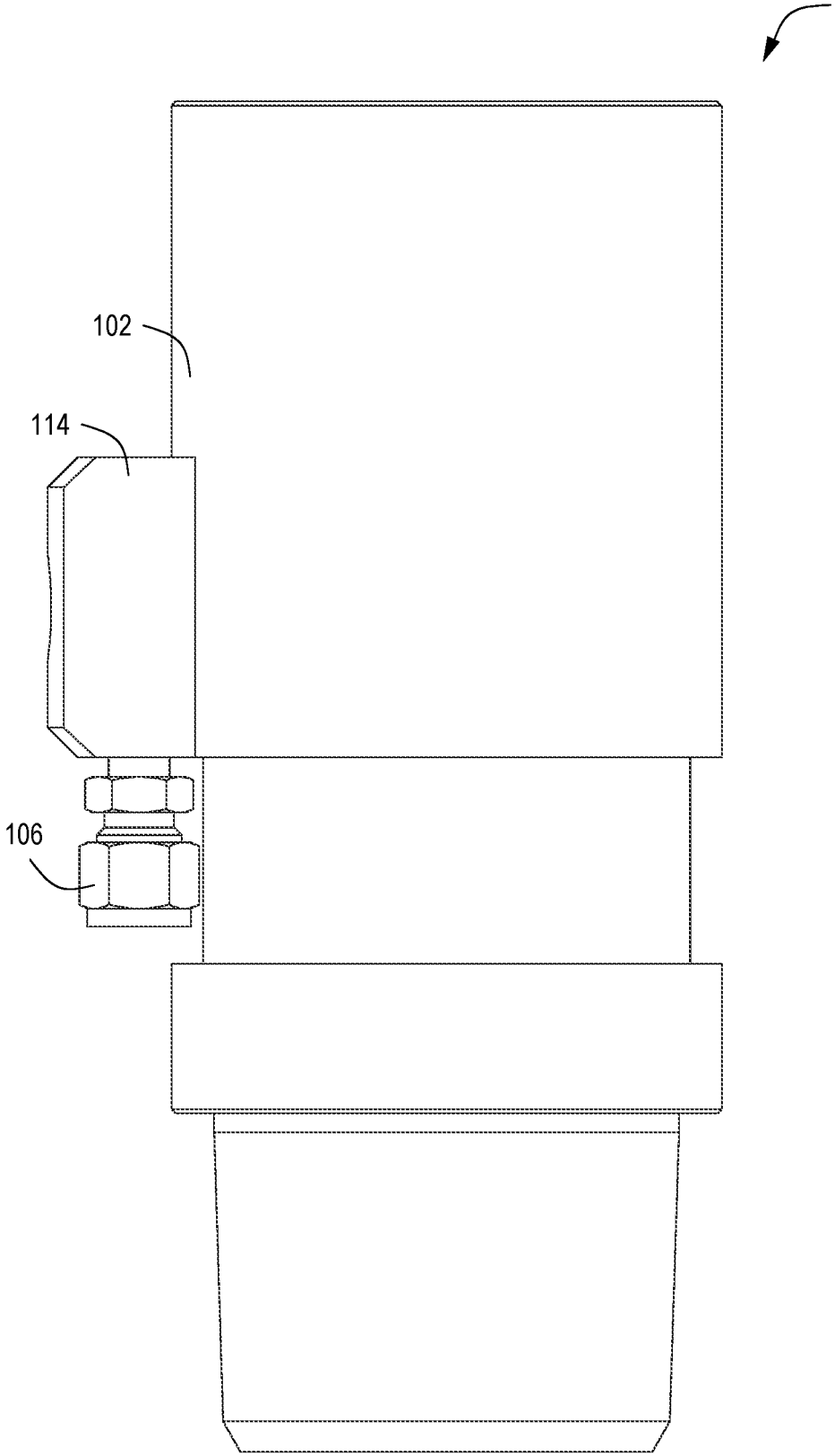
FIG. 3B is an illustration of a side profile view of a valve assembly.

A tap 108 (see FIGS. 3A-B) is coupled to the housing 102 of the valve assembly 100. A recirculation conduit 408 is coupled to the tap 108.

Figure 5:
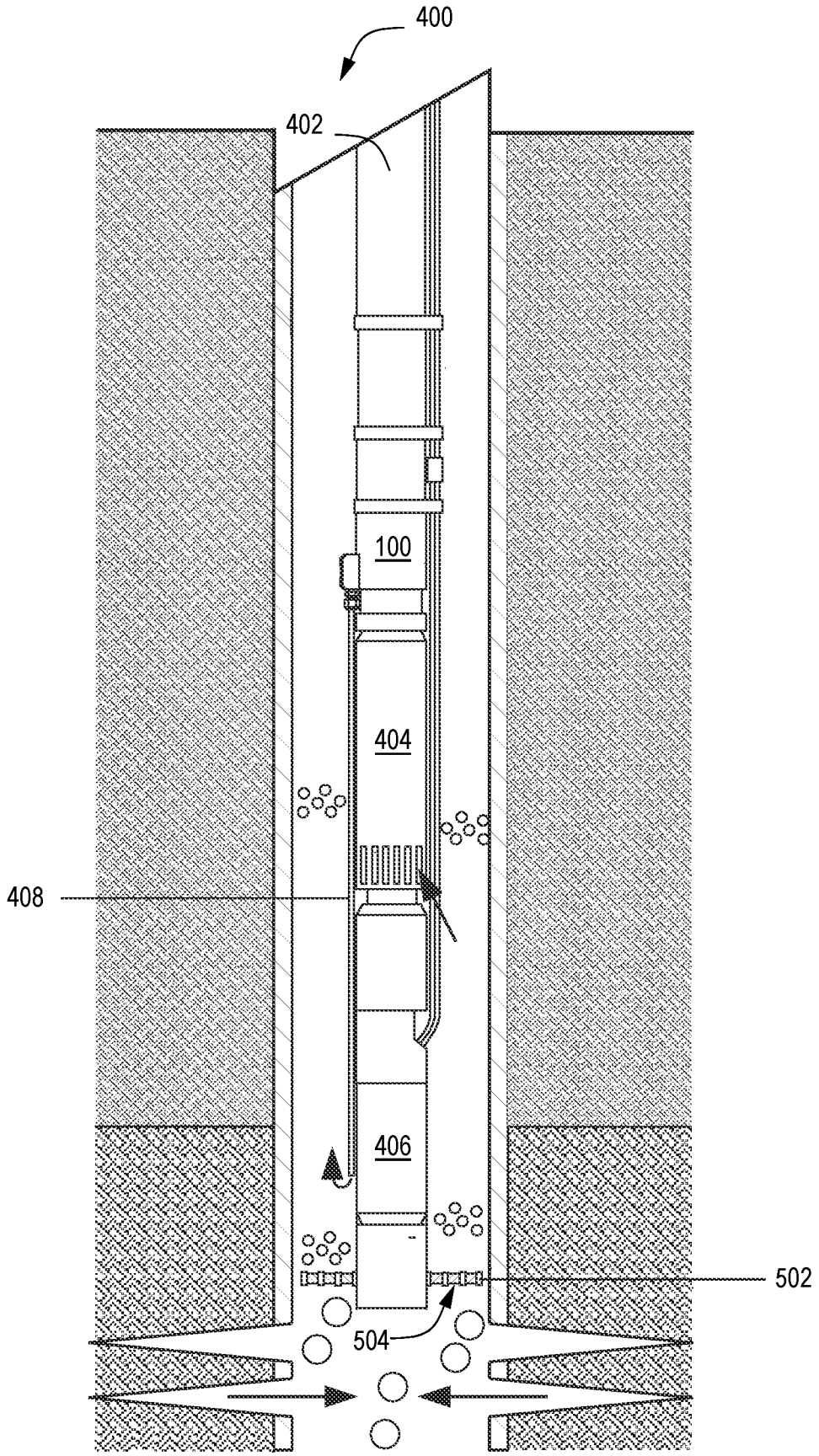
FIG. 5 is an illustration of an electric submersible pump assembly that includes a valve assembly and bubble-breaking screen, wherein the electric submersible pump assembly is disposed downhole.

FIG. 5 is an illustration of an electric submersible pump assembly 400 that includes a valve assembly 100 and a bubble-breaking screen 502, wherein the electric submersible pump assembly 400 is disposed downhole. The ESP assembly 400 includes a tubular string 402, the valve assembly 100, a pump 404, a motor 406, and bubble-break screen 502. A lower end of the tubular string is coupled to an upper end of the valve assembly 100. An upper end of the pump 404 is coupled to a lower end of the valve assembly 100. An upper end of the motor 406 is coupled to a lower end of the pump 404. The bubble-breaking screen 502 is coupled to a lower end of the motor 406. In addition, the bubble-breaking screen 502 is disposed below intake ports of the pump 402. Furthermore, the bubble-breaking screen 502 has a plurality of apertures extending therethrough. When disposed downhole in a wellbore, fluid and bubble pass through apertures.

A tap 108 is coupled to the housing 102 of the valve assembly 100. A recirculation conduit 408 is coupled to the tap 108.

FIG. 4 and FIG. 5 depict wellbores that are a vertical, having ESP assemblies 400 disposed therein. However, it should be understood that the ESP assembly 400 may also be used in a horizontal wellbore.

Referring to FIGS. 2A-B and FIG. 4, to perform recirculation of fluid in a wellbore using an ESP assembly 400 that includes a valve assembly 100, an operator may deploy, on a tubular string 402, the electric submersible pump assembly 400 to a pre-determined location, e.g., depth, in an oil and gas reservoir. Prior and up to the point of deployment downhole, the valve assembly 100 includes a valve 104 that is not broken. In other words, a first end portion 202*a* and a second end portion 202*b* of the valve 104 are unitary and intact.

The operator may then operate the ESP assembly 400 to "produce" fluid, e.g., hydrocarbon, gas, and water, in the wellbore to surface. As shown by the arrows in FIG. 4, the fluid in the wellbore may enter the ESP assembly 400 through intake ports in a pump 404. An impeller (not shown) being turned in the pump 404 may push the fluid up the ESP assembly 400 and through a screen 110 in the valve assembly 100. The fluid may continue to flow through a housing 102 of the valve assembly 100. From the valve assembly 100, the fluid may continue to flow up the tubular string 402 toward surface.

At some later time, e.g., several months or years, after deployment of the ESP assembly 400 and the valve assembly 100 downhole, the operator may need to recirculate fluid in the ESP assembly 400 back into the wellbore near or below a motor 406 or the pump 404. The need for recirculation may arise from changes in the consistency of fluid being pumped from the reservoir. The changes may include fluid containing more gas than liquid hydrocarbon. The increased proportion of gas to liquid may require the ESP assembly 400 to operate longer to pump a similar volume of liquid as before, which would lead to the ESP assembly 400 generating more internal heat. Prolonged operation and exposure to heat risks quicker wear and damage to the motor 406. Thus, during production of fluid in the wellbore, recirculated fluid may help to cool the motor 406 during operation. To start, the operator may deploy a jar device (not shown) inside the tubular string 402 down in the valve assembly 100 to the valve 104. The operator may then active the jar device to break, e.g., via vibration or concussion, the first end portion 202*a* and the second end portion 202*b* of the valve 104 at a notch 204. The first end portion 202*a* may remain threadably coupled the housing 102. However, the second end portion 202*b* would fall onto a screen 110, which would prevent the second end portion 202*b* from falling into the pump 404.

As fluid is pumped into the valve assembly 100 by the pump 404, pressure inside of the valve assembly 100 would be greater than pressure outside of the ESP assembly 400, e.g., in an annular space between the ESP assembly 400 and a casing of the wellbore. Thus, fluid in the housing 102 may flow, e.g., in a radial direction, into a valve borehole 206 extending through the first end portion 202*a* that is now open after the first end portion 202*a* and the second end portion 202*a* separated. The fluid may then flow out of the valve borehole 206 into a first aperture 116. The fluid may then flow towards a plug 106 that is threadably coupled to the housing 102, and held firmly thereto. However, the plug 106 would prevent the fluid from flowing in its original direction, e.g., radially. Instead, the plug 106 may cause the fluid to flow, e.g., in an axial direction, towards a second aperture 118. A tap 108 may be disposed in the second aperture 118. Thus, the fluid may flow through the tap 118 into a recirculation conduit 408 that is coupled to the tap 108. The recirculation conduit 408 may extend a distance, e.g., several meters, down the ESP assembly 400. The end of the recirculation conduit 408 may have an opening near a motor 406. The fluid exiting the recirculation conduit 408 may be cooler than the running motor 406. Hence, the fluid may absorb heat from the running motor 406.

In some cases, when producing fluid in a wellbore, the fluid may contain large gas bubbles, e.g., 1 mm or greater in diameter. The presence of large gas bubbles in wellbore fluid may result in a lower fluid density in the wellbore than if no to little gas bubbles were present. Lower fluid density also may lead to lower pressure in the wellbore. Consequently, an ESP assembly 400 would have to operate longer to pump fluid containing bubbles than fluid having little to no gas bubbles. Running the ESP assembly longer than normal may cause quicker wear and damage to components.

Therefore, referring to FIGS. 2A-B and FIGS. 5, an operator may deploy an ESP assembly 400 that includes a valve assembly 100 and a bubble-breaking screen 502 to perform recirculation of fluid in a wellbore that produces gas bubbles. The operator may deploy and operate, on a tubular string 402, an electric submersible pump assembly 400 as similarly described above for FIG. 4.

In cases where large bubbles are present in the wellbore, as bubbles and fluid enter the wellbore from downhole formations, the rising bubbles will reach the bubble-breaking screen 502 before reaching a pump 404 of the ESP assembly 400. The upward flowing fluid in the wellbore may force the large bubbles through apertures in the bubble-breaking screen 502. Forced through the bubble-breaking screen 502, the large bubbles would break into smaller bubbles until they can pass through the bubble-breaking screen 502. The smaller bubbles in the wellbore fluid would result in the fluid being denser because the smaller bubbles would mix more with the recirculated liquid flow current coming from the conduit 408, as compared to fluid having bigger bubbles.

What is claimed as the invention is:

1. A downhole valve assembly, comprising:
- a housing that comprises:
  - an axially disposed cylindrical wall;
  - an axially disposed borehole surrounded by the cylindrical wall;
  - a housing aperture extending radially through the cylindrical wall to the borehole; and
  - a recirculation aperture having a central axis that intersects with a central axis of the housing aperture;
- a valve threadably coupled to the cylindrical wall, the valve comprising:
  - a first valve end disposed in the housing aperture; and
  - a second valve end disposed in the borehole; and
- a plug coupled to the cylindrical wall and having an inner end disposed in the housing aperture, wherein the plug inhibits any fluid that flows through the valve from flowing past the plug.

2. The downhole valve assembly of claim 1, wherein the housing additionally comprises a knob extending radially from the cylindrical wall.

3. The downhole valve assembly of claim 1, wherein the recirculation aperture extends axially from an outer surface of a knob to the housing aperture.

4. A downhole valve assembly, comprising:
- a housing that comprises:
  - a cylindrical wall;
  - a borehole surrounded by the cylindrical wall;
  - a knob extending from the cylindrical wall;
  - a housing aperture extending radially through the knob and the cylindrical wall to the borehole; and
  - a recirculation aperture extending axially from an outer surface of the knob to the housing aperture;
- a valve threadably coupled to the cylindrical wall, the valve comprising:
  - a first valve end disposed in the housing aperture;
  - a second valve end disposed in the borehole; and
  - a valve aperture extending through the first valve end; and
- a plug coupled to the cylindrical wall and disposed in the housing aperture, wherein the plug inhibits any fluid that flows through the valve from flowing past the plug.

5. The downhole valve assembly of claim 4, wherein the plug is threadably coupled to the cylindrical wall.

6. The downhole valve assembly of claim 4, wherein the plug and the valve are disposed a distance apart.

7. The downhole valve assembly of claim 4, wherein the plug is capable of causing fluid to flow from the housing aperture to the recirculation aperture.

8. The downhole valve assembly of claim 4, wherein the plug is capable of causing fluid from the housing aperture to flow away from the plug.

9. The downhole valve assembly of claim 4, wherein the plug is capable of causing fluid from the housing aperture to flow from a radial direction to an axial direction relative to a central axis of the housing.

10. The downhole valve assembly of claim 4, wherein the first valve end is disposed in the housing aperture.

11. The downhole valve assembly of claim 4, wherein the first valve end has a diameter greater than the diameter of the second valve end.

12. The downhole valve assembly of claim 4, wherein the valve comprises a notch located between the first valve end and the second valve end, and the notch has a diameter less than a diameter of the second valve end.

13. The downhole valve assembly of claim 4, wherein the valve aperture also extends through at least a portion of the second valve end.

14. The downhole valve assembly of claim 4, further comprising a screen disposed in the borehole.

15. The downhole valve assembly of claim 4, further comprising a screen disposed in the borehole below the valve.

16. The downhole valve assembly of claim 4, further comprising a screen disposed in the borehole that is capable of inhibiting any portion of the valve from passing through the screen.

17. A downhole valve assembly, comprising:
- a housing that comprises:
  - a cylindrical wall;
  - a borehole extending axially through the housing;
  - a housing aperture extending radially through the cylindrical wall to the borehole; and
  - a flange disposed in the housing aperture and extending from the cylindrical wall;
- a valve threadably coupled to the cylindrical wall, the valve comprising:

a first valve end disposed in the housing aperture and abutted against the flange;

a second valve end disposed in the borehole;

a valve notch disposed between the first valve end and the second valve end; and a valve aperture extending through the first valve end; and a plug coupled to the cylindrical wall and disposed in the housing aperture, wherein the plug inhibits any fluid that flows through the valve from flowing past the plug.

18. The downhole valve assembly of claim 17, wherein the first valve end and the second valve end are capable of being separated at the valve notch.

19. The downhole valve assembly of claim 17, wherein the second valve end is capable of being broken from the valve notch.

20. The downhole valve assembly of claim 17, wherein the second valve end is capable of being separated from the valve notch.

* * * * *